US011363693B2

(12) United States Patent
Chen et al.

(10) Patent No.: US 11,363,693 B2
(45) Date of Patent: *Jun. 14, 2022

(54) POWER CONVERTER AND CONTROL METHOD THEREOF

(71) Applicant: Silergy Semiconductor Technology (Hangzhou) LTD, Hangzhou (CN)

(72) Inventors: Huiqiang Chen, Hangzhou (CN); Zhishuo Wang, Hangzhou (CN); Jianxin Wang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/327,887

(22) Filed: May 24, 2021

(65) Prior Publication Data

US 2021/0282243 A1 Sep. 9, 2021

Related U.S. Application Data

(63) Continuation of application No. 16/434,361, filed on Jun. 7, 2019, now Pat. No. 11,026,308.

(30) Foreign Application Priority Data

Jul. 6, 2018 (CN) ..... 201810734246.X

(51) Int. Cl.
*H05B 45/10* (2020.01)
*H05B 45/37* (2020.01)

(52) U.S. Cl.
CPC ..... *H05B 45/37* (2020.01); *H05B 45/10* (2020.01)

(58) Field of Classification Search
CPC ..... H05B 45/10; H05B 45/31; H05B 45/37; H05B 45/382; H05B 45/395; H05B 45/3575
See application file for complete search history.

(56) References Cited

U.S. PATENT DOCUMENTS

| | | | | |
|---|---|---|---|---|
| 8,581,518 | B2 | 11/2013 | Kuang et al. | |
| 10,405,392 | B1 | 9/2019 | Shi et al. | |
| 2011/0127925 | A1 | 6/2011 | Huang et al. | |
| 2012/0319610 | A1* | 12/2012 | Yoshinaga | H05B 45/3575 315/210 |
| 2013/0241427 | A1 | 9/2013 | Kesterson et al. | |
| 2014/0062330 | A1 | 3/2014 | Neundorfer et al. | |
| 2014/0111113 | A1 | 4/2014 | Del Carmen, Jr. | |
| 2014/0159616 | A1* | 6/2014 | Wang | H05B 45/10 315/307 |

(Continued)

FOREIGN PATENT DOCUMENTS

CN 107979888 A 5/2018

*Primary Examiner* — Tung X Le

(57) ABSTRACT

A power converter can include: a rectifier circuit; a silicon controlled dimmer coupled between an AC input terminal and an input terminal of the rectifier circuit; and a bleeder circuit coupled to an output terminal of the rectifier circuit, and being configured to provide a bleeder current after the silicon controlled dimmer is turned off. A method of controlling a power converter, can include: generating a bleeder current flowing though output terminals of a rectifier circuit of the power converter after a silicon controlled dimmer is turned off; and where the silicon controlled dimmer coupled to the rectifier circuit receives an AC input voltage.

23 Claims, 11 Drawing Sheets

(56) References Cited

U.S. PATENT DOCUMENTS

| | | | | |
|---|---|---|---|---|
| 2014/0368119 | A1* | 12/2014 | Lee | H05B 45/397 315/307 |
| 2015/0359053 | A1 | 12/2015 | van den Broeke | |
| 2016/0014865 | A1* | 1/2016 | Zhu | H05B 45/10 315/223 |
| 2016/0081151 | A1 | 3/2016 | Wang et al. | |
| 2016/0128142 | A1 | 5/2016 | Arulandu et al. | |
| 2017/0223794 | A1 | 8/2017 | Lewis et al. | |
| 2017/0318639 | A1 | 11/2017 | Wang et al. | |
| 2018/0139816 | A1 | 5/2018 | Liu et al. | |
| 2018/0295685 | A1 | 10/2018 | Wang et al. | |
| 2018/0295690 | A1 | 10/2018 | Chen et al. | |
| 2018/0310376 | A1 | 10/2018 | Huang et al. | |
| 2019/0124736 | A1* | 4/2019 | Zhu | H05B 45/395 |

* cited by examiner

POWER CONVERTER AND CONTROL METHOD THEREOF

RELATED APPLICATIONS

This application is a continuation of the following application, U.S. patent application Ser. No. 16/434,361, filed on Jun. 7, 2019, and which is hereby incorporated by reference as if it is set forth in full in this specification, and which also claims the benefit of Chinese Patent Application No. 201810734246.X, filed on Jul. 6, 2018, which is incorporated herein by reference in its entirety.

FIELD OF THE INVENTION

The present invention generally relates to the field of power electronics, and more particularly to power converters and associated control methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
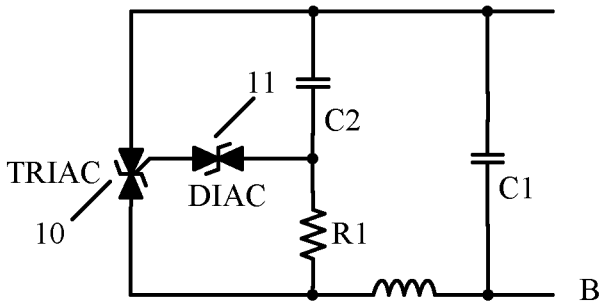
FIG. 1 is a schematic block diagram of an example equivalent model of a silicon-controlled dimmer.

Silicon-controlled rectifier dimming is a commonly used dimming method. Referring now to FIG. 1, shown is a schematic block diagram of an example equivalent model of a silicon-controlled dimmer. In this example, the silicon-controlled dimmer may include a triac that is a current-controlled device equivalent to reverse parallel thyristors.

Figure 2:
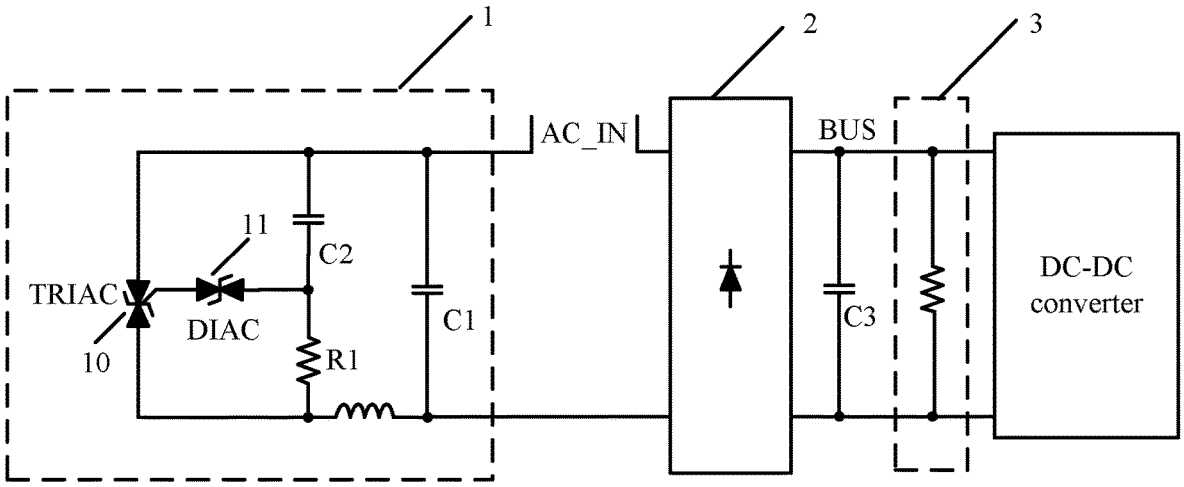
FIG. 2 is a schematic block diagram of an example power converter.

Referring now to FIG. 2, shown is a schematic block diagram of an example power converter. When the current flowing through the triac drops below a holding current of the triac, the triac turns off. At this time, the parasitic capacitance (mainly C1) of the triac can affect an output voltage of rectifier circuit 2. A parasitic capacitance (e.g., C3) may exist between the output terminal of rectifier circuit 2 and the ground terminal. When an AC input voltage at the AC input terminals drops, the parasitic capacitance can prevent the output voltage of rectifier circuit 2 from changing, thereby causing the output voltage of rectifier circuit 2 to be greater than the AC input voltage. When the triac is not turned off at the lowest point of the output voltage of rectifier circuit 2, the output voltage of rectifier circuit 2 may not be consistent with the absolute value of the waveform of the AC input voltage, which can cause the silicon-controlled dimmer to not be normally turned on in the next period.

In order to reduce the influence of capacitors C1 and C3, resistor 3 can connect between output terminals of rectifier circuit 2 to provide a bleeder current by the shunting characteristic of resistor 3. In this approach, since the power converter may be tested without a silicon-controlled dimmer under certification standards, the resistor for providing the bleeder current may disadvantage system efficiency. If the bleeder current is too large or too small, the detection for the output voltage of the rectifier circuit may be problematic, thereby affecting integration of the current before the triac of the silicon-controlled dimmer is turned on.

As shown in FIG. 1, the silicon-controlled dimmer may include triac 10 equivalent to reverse parallel thyristors, and diac 11. When the silicon-controlled dimmer receives an AC input voltage at AC input terminals A and B, the AC input voltage can charge capacitor C2 through resistor R1. As the charging progresses, when the voltage of capacitor C2 reaches a certain value, diac 11 may be turned on, and the voltage of capacitor C2 can be provided to the gate of triac 10 through diac 11, such that triac 10 can be triggered to be in an on state. When the current flowing through triac 10 drops below the holding current, triac 10 may be switched to an off state from the on state. The dimming angle of triac 10 can control the delay from the zero crossing of the AC input voltage to modulate the AC input voltage, thereby achieving chopping the AC input voltage.

As shown in FIG. 2, the power converter can include silicon-controlled dimmer 1, rectifier circuit 2, and resistor 3. In the power converter, silicon-controlled dimmer 1 can connect between one AC input terminal and one input terminal of rectifier circuit 2, and can chop the AC input voltage, in order to control the power delivered to rectifier circuit 2. Rectifier circuit 2 can convert the AC input voltage to a DC voltage, and may provide the DC voltage along a DC bus to a DC-DC converter. Rectifier circuit 2 can include a main circuit, a filter, and a transformer. The main circuit can include a silicon rectifier diode and a thyristor. Resistor 3 can connect to the output terminals of rectifier circuit 2, and parasitic capacitance C3 of the DC bus can be discharged by a bleeder current provided by parallel-connected resistor 3. However, the waveform of the bleeder current provided by resistor 3 may follow the waveform of the output voltage of rectifier circuit 2, such that the release ability of resistor 3 can be poor when the output voltage of rectifier circuit 2 is low.

Figure 3:
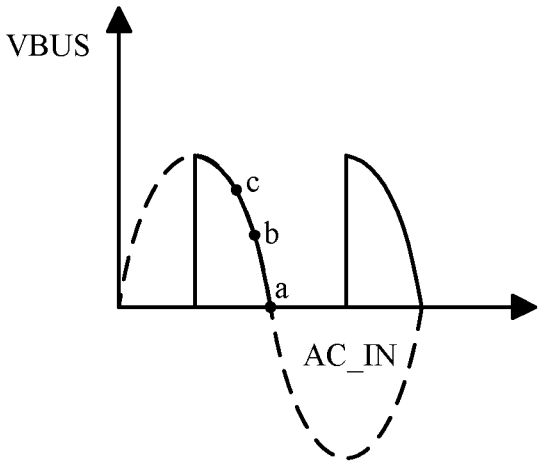
FIG. 3 is a waveform diagram of an example output voltage of a rectifier circuit under an appropriate bleeder current.

Referring now to FIG. 3, shown is a waveform diagram of an example output voltage of a rectifier circuit under an appropriate bleeder current. In this particular example, when the bleeder current is appropriate, output voltage VBUS of rectifier circuit 2 can remain identical or substantially consistent with the absolute value of the waveform of AC input voltage AC_IN at the AC input terminals, such that the voltage of the subsequent circuit may not adversely affect the conduction of the silicon-controlled dimmer.

Figure 4:
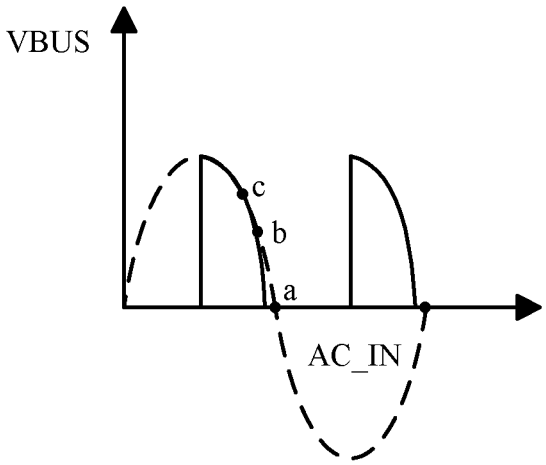
FIG. 4 is a waveform diagram of an example output voltage of a rectifier circuit under a larger bleeder current.

Referring now to FIG. 4, shown is a waveform diagram of an example output voltage of a rectifier circuit under a larger bleeder current. In this particular example, when the bleeder current is too large, output voltage VBUS of rectifier circuit 2 drops too fast after silicon-controlled dimmer 1 is turned off, such that output voltage VBUS is less than AC input voltage AC_IN, and may not be consistent with the absolute value of AC input voltage AC_IN, thereby affecting the conduction of the silicon-controlled dimmer in the next period.

Figure 5:
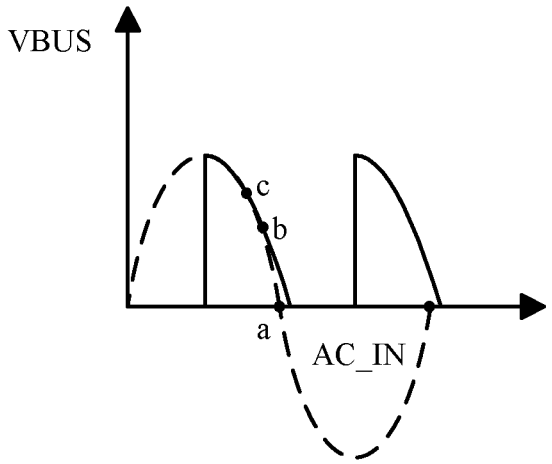
FIG. 5 is a waveform diagram of an example output voltage of a rectifier circuit under a smaller bleeder current.

Referring now to FIG. 5, a waveform diagram of an example output voltage of a rectifier circuit under a smaller bleeder current. In this particular example, when the bleeder current is too small, output voltage VBUS of rectifier circuit 2 drops too slow after silicon-controlled dimmer 1 is turned off, such that output voltage VBUS is greater than AC input voltage AC_IN, and may not be consistent with the absolute value of AC input voltage AC_IN, thereby affecting the conduction of the silicon-controlled dimmer in the next period. It can be seen from the comparison of FIGS. 3-5 that if the bleeder current is too large or too small, output voltage VBUS of the rectifier circuit may be detected incorrectly, such that the silicon-controlled dimmer may not be normally turned on in the next period, thereby affecting the stability of the overall circuit/system.

In one embodiment, a power converter can include: (i) a rectifier circuit; (ii) a silicon controlled dimmer coupled between an alternating current (AC) input terminal and an input terminal of the rectifier circuit; and (iii) a bleeder circuit coupled to an output terminal of the rectifier circuit, and being configured to provide a bleeder current after the silicon controlled dimmer is turned off. In one embodiment, a method of controlling a power converter, can include: (i) generating a bleeder current flowing though output terminals of a rectifier circuit of the power converter after a silicon controlled dimmer is turned off; and (ii) where the silicon controlled dimmer coupled to the rectifier circuit receives an AC input voltage.

Figure 6:
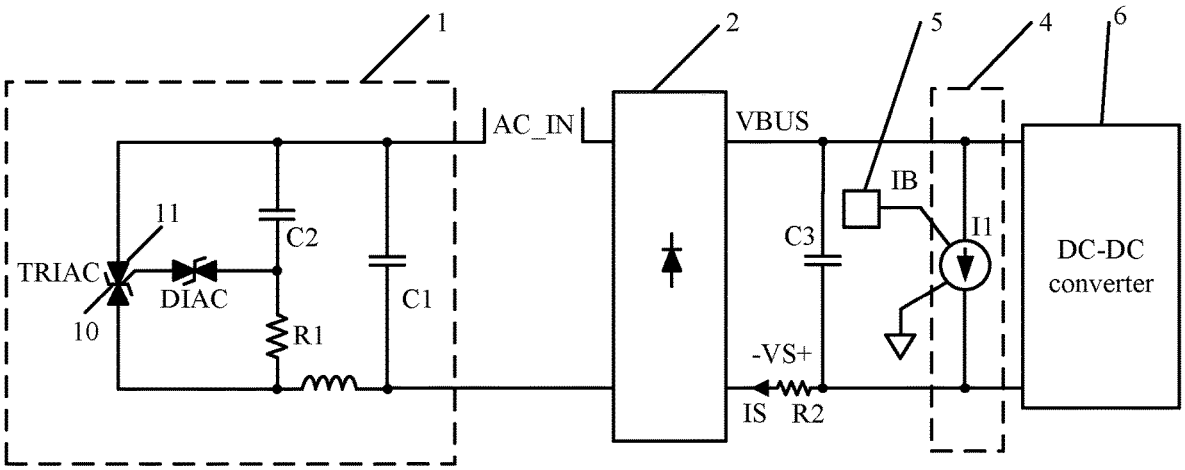
FIG. 6 is a schematic block diagram of an example power converter, in accordance with embodiments of the present invention.

Referring now to FIG. 6, shown is a schematic block diagram of an example power converter, in accordance with embodiments of the present invention. This example power converter can include silicon-controlled dimmer 1, rectifier circuit 2, bleeder circuit 4, control circuit 5, and DC-DC converter 6. In the power converter, silicon-controlled dimmer 1 can connect between one AC input terminal and one input terminal of rectifier circuit 2, in order to chop the AC input voltage and control the power delivered to rectifier circuit 2, thereby realizing dimming. Rectifier circuit 2 can connect to silicon-controlled dimmer 1, and may convert the chopped AC input voltage into a DC voltage. In particular embodiments, the rectifier circuit may employ a half-wave rectifier circuit, a full-wave rectifier circuit, a bridge rectifier, or the like. Bleeder circuit 4 can connect to the output terminals of rectifier circuit 2, and may draw a bleeder current after silicon-controlled dimmer 1 is turned off, until output voltage VBUS of rectifier circuit 2 is less than a predetermined value.

In this particular example, the bleeder circuit of the power converter can be controlled to provide the bleeder current after the silicon-controlled dimmer is turned off, thereby reducing the negative influence on the output voltage of the rectifier circuit caused by the capacitance of the silicon-controlled dimmer and the parasitic capacitance between the DC bus and the ground. In particular embodiments, the output voltage of the rectifier circuit can remain identical or substantially consistent with the absolute value of the AC input voltage at the AC input terminals, such that the silicon-controlled dimmer can be stably turned on during each period. DC-DC converter 6 can connect to the subsequent stage of rectifier circuit 2, and may perform the function of DC-DC conversion for the voltage output of rectifier circuit 2, in order to provide a converted voltage or current to drive a subsequent stage circuit or directly drive a load. DC-DC converter 6 can be a switching converter or a linear constant current converter in the application as a LED driver.

For example, output current IS of rectifier circuit 2 can be detected by connecting sampling resistor R2 in series with one output terminal of rectifier circuit 2. Voltage VS across sampling resistor R2 can be used as a current sampling signal to characterize the value of output current IS. In this example, when silicon-controlled dimmer 1 is not turned off at the valley of output voltage VBUS of rectifier circuit 2 (e.g., point a in FIGS. 3-5), but is turned off when output voltage VBUS of rectifier circuit 2 is greater than 0V (e.g., point b and c in FIGS. 3-5), the output voltage of rectifier circuit 2 may need to be pulled down. Further, bleeder circuit 4 can provide the bleeder current after silicon-controlled dimmer 1 is turned off, such that the negative influence caused by the capacitance of silicon-controlled dimmer 1 and the parasitic capacitance between the DC bus and the ground can be reduced. Also, the output voltage of rectifier circuit 2 can be kept identical or substantially consistent with the absolute value of AC input voltage AC_IN at the AC input terminals, thereby maintaining the silicon-controlled dimmer stably turned on during each period.

In addition, bleeder circuit 4 can be provided as controlled current source I1, controlled by control circuit 5, such that bleeder circuit 4 can be controlled to operate or stop operating under the control of control circuit 5. Further, the timing of when bleeder circuit 4 can be controlled to operate and to stop operating can be determined at different moments, as long as output voltage VBUS of rectifier circuit 2 can be kept identical or substantially consistent with the absolute value of AC input voltage AC_IN at the AC input terminals. In one example, control circuit 5 can control controlled current source I1 to provide the bleeder current immediately upon detecting that silicon-controlled dimmer 1 is turned off. The bleeder current can be set by trial, such that output voltage VBUS of rectifier circuit 2 can be kept identical or substantially consistent with the absolute value of AC input voltage AC_IN at the AC input terminals during the falling phase of output voltage VBUS.

Figure 7:
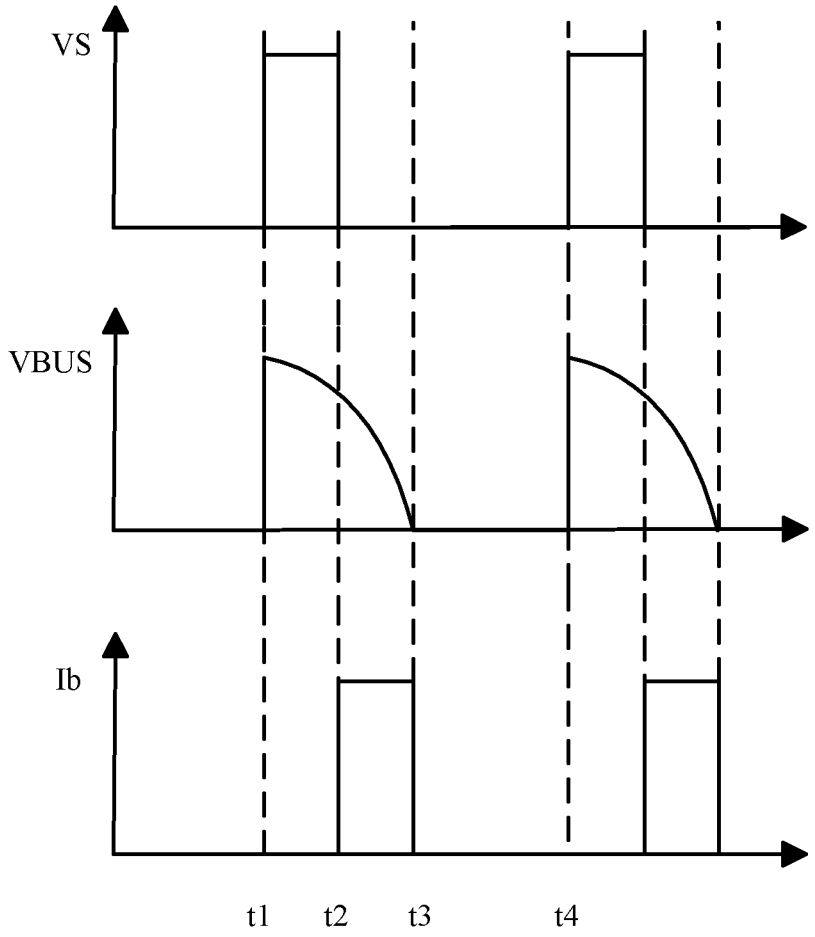
FIG. 7 is a waveform diagram of a first example operation of the power converter, in accordance with embodiments of the present invention.

Referring now to FIG. 7, shown is waveform diagram of first example operation of the power converter, in accordance with embodiments of the present invention. In this particular example, at time t1, silicon-controlled dimmer 1 is turned on, and the value of voltage VBUS may be the same as the absolute value of AC input voltage AC_IN, such that the entire system can operate. Also, the output current of rectifier circuit 2 may change from 0 to a predetermined value and held until time t2. At time t2, silicon-controlled dimmer 1 can be turned off, which can cause output current IS of rectifier circuit 2 to drop to zero or to approach zero. Correspondingly, current sampling signal VS can also drops to zero or approach zero. By detecting current sampling signal VS, whether the bleed circuit is required to operate can be determined. At the same time, due to the presence of parasitic capacitance, voltage VBUS may gradually decrease.

As shown in FIG. 7, at time t2, after control circuit 5 detects that current sampling signal VS is less than a predetermined threshold (e.g., the output current of the rectifier circuit is less than a current threshold), silicon-controlled dimmer 1 can be determined to be turned off, such that bleeder circuit 4 can be immediately controlled to provide the bleeder current, and controlled current source I1 can generate the bleeder current. At time t3, when voltage VBUS falls below the preset value (e.g., substantially toward zero), control circuit 5 can control bleeder circuit 4 to stop providing the bleeder current. In this example, bleeder current Ib is constant from time t3 to t4. It should be understood that the timing of when bleeder circuit 4 stops operating may be set at other moments before time t4 at which silicon-controlled dimmer 1 is turned on in the next period.

Figure 8:
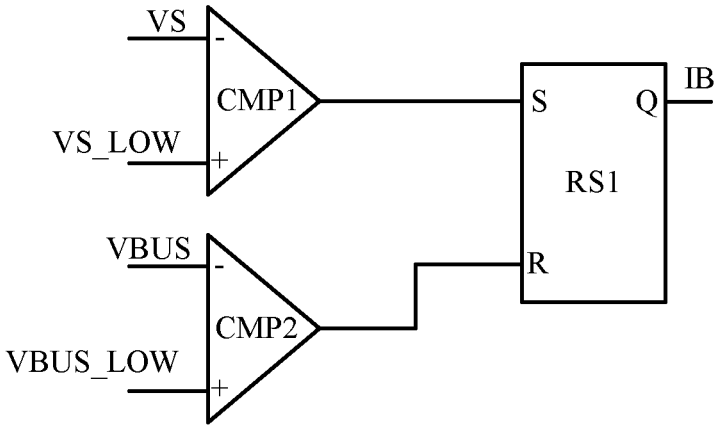
FIG. 8 is a schematic block diagram of an example control circuit, in accordance with embodiments of the present invention.

Referring now to FIG. 8, shown is a schematic block diagram of an example control circuit, in accordance with embodiments of the present invention. In this particular example, control circuit 5 can include comparators CMP1 and CMP2, and RS flip-flop RS1. Comparator CMP1 can compare current sampling signal VS against current threshold VS_LOW. When current sampling signal VS falls below current threshold VS_LOW, the output current of rectifier circuit 2 can be considered to fall to zero. Comparator CMP2 can compare output voltage VBUS of rectifier circuit 2 against predetermined value VBUS_LOW. When output voltage VBUS falls below preset value VBUS_LOW, output voltage VBUS can be considered to approach zero. RS flip-flop RS1 has a set terminal connected to an output terminal of comparator CMP1, a reset terminal connected to an output terminal of comparator CMP2, and an output terminal connected to a control terminal of bleeder circuit 4 (e.g., the control terminal of the controlled current source).

Further, with reference to FIG. 7, when current sampling signal VS is detected to be less than current threshold VS_LOW at time t2, silicon-controlled dimmer 1 can be considered to be turned off, and the output current of rectifier circuit 2 may drop to zero. Control circuit 5 can control the bleeder circuit to operate by control signal IB, in order to provide constant bleeder current Ib, and maintain output voltage VBUS identical or substantially consistent with the absolute value of AC input voltage AC_IN at the AC input terminals. At time t3, output voltage VBUS of rectifier circuit 2 may be lower than preset value VBUS_LOW, which can indicate that output voltage VBUS of rectifier circuit 2 is close to zero, such that control circuit 5 can control bleeder circuit 4 to stop operating by control signal IB.

In this example, after silicon-controlled dimmer 1 is turned off, the control circuit can immediately control the bleeder circuit to start operating, such that the bleeder circuit has sufficient time to operate. The bleeder current can be provided in a relatively gentle manner to maintain the output voltage of the rectifier circuit identical or substantially consistent with the absolute value of AC input voltage AC_IN at the AC input terminals during the falling phase of output voltage VBUS.

Figure 9:
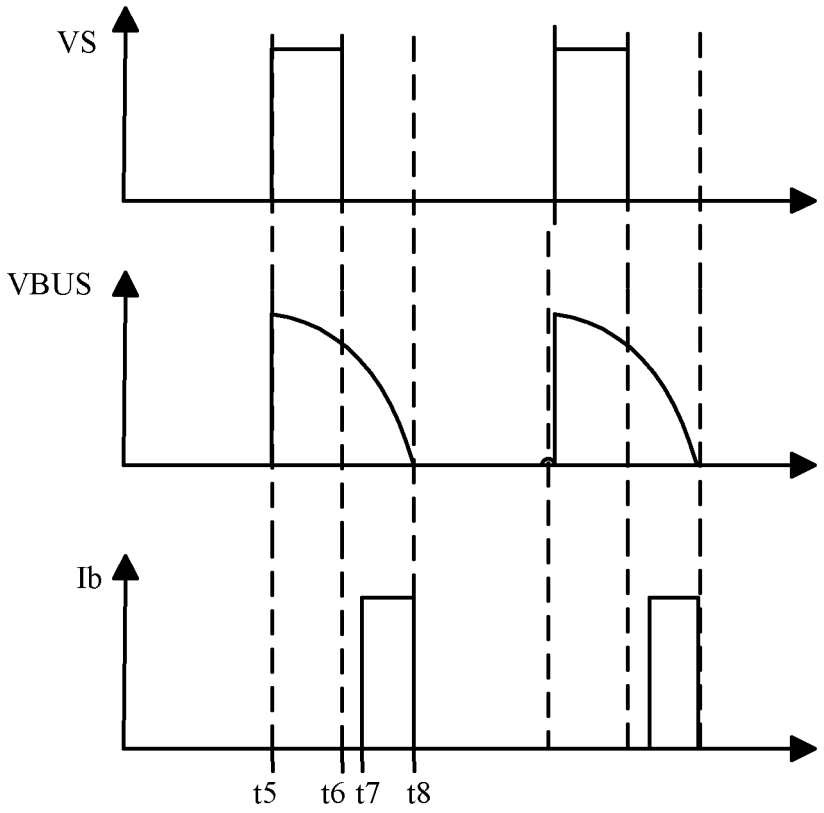
FIG. 9 is a waveform diagram of a second example operation of the power converter, in accordance with embodiments of the present invention.

Referring now to FIG. 9, shown is a waveform diagram of a second example operation of the power converter, in accordance with embodiments of the present invention. As shown in FIG. 9, at time t5, silicon-controlled dimmer 1 may be turned on, and the value of voltage VBUS can be the same as the absolute value of AC input voltage AC_IN, such that the entire system can operate. Also, the output current of rectifier circuit 2 can change from 0 to a predetermined value and held until time t6. At time t6, silicon-controlled dimmer 1 is turned off, which can cause output current IS of rectifier circuit 2 to drop to zero or to approach zero. Correspondingly, current sampling signal VS can also drops to zero or approaches zero. By detecting current sampling signal VS, whether or not the bleed circuit is controlled to operate can be determined. In addition, due to the presence of parasitic capacitance, voltage VBUS will gradually decrease.

As shown in FIG. 9, at time t6, after control circuit 5 detects that current sampling signal VS is less than the predetermined threshold (e.g., the output current of the rectifier circuit is less than the current threshold), silicon-controlled dimmer 1 can be determined to be turned off. After waiting for predetermined time Δt1, that is at time t7, bleeder circuit 4 can be controlled to provide the bleeder current. At time t8, when voltage VBUS falls below the preset value (e.g., substantially toward zero), control circuit 5 can control bleeder circuit 4 to stop providing the bleeder current. It should be understood that the timing of when the bleeder circuit stops operating may be set at other moments before time t4 at which silicon-controlled dimmer 1 is turned on in the next period.

Figure 10:
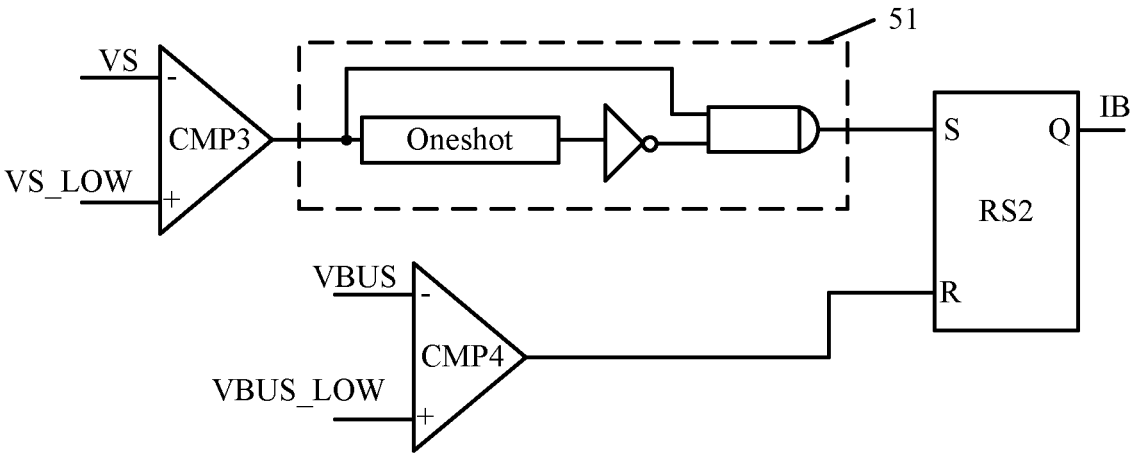
FIG. 10 is a schematic block diagram of another example control circuit, in accordance with embodiments of the present invention.

Referring now to FIG. 10, shown is a schematic block diagram of another example control circuit, in accordance with embodiments of the present invention. As shown in FIG. 10, control circuit 5 can include comparators CMP3 and CMP4, delay circuit 51, and RS flip-flop RS2. In this example, comparator CMP3 can compare current sampling signal VS against current threshold VS_LOW. When current sampling signal VS falls below current threshold VS_LOW, the output current of rectifier circuit 2 can be considered to fall to zero. In addition, comparator CMP4 can compare output voltage VBUS of rectifier circuit 2 against preset value VBUS_LOW. When voltage VBUS falls below preset value VBUS_LOW, output voltage VBUS can be considered to approach zero.

The input terminal of delay circuit 51 can connect to the output terminal of comparator CMP3 for delaying the output signal of comparator CMP3 for predetermined time Δt1. Delay circuit 51 can include single trigger circuit oneshot, and single trigger circuit oneshot can transition from a steady state to a transient state. Due to the delay of the RC delay link in single trigger circuit oneshot, the transient state can remain for a predetermined time, and then be back to original steady state, such that predetermined time Δt1 can be set according to the RC parameter in single trigger circuit oneshot. RS flip-flop RS2 may have a set terminal connected to the output terminal of delay circuit 51, a reset terminal connected to the output terminal of comparator CMP4, and an output terminal connected to the control terminal of bleeder circuit 4 (e.g., the control terminal of the controlled current source).

Further, comparator CMP3 can compare current sampling signal VS against current threshold VS_LOW. When current sampling signal VS falls below current threshold VS_LOW at time t6, the output current of rectifier circuit 2 can be considered to fall to zero, silicon-controlled dimmer 1 can be considered to be turned off, and the output current of rectifier circuit 2 can drop to zero. After delay circuit 51 delays the output signal of comparator CMP3 for predetermined time Δt1, that is at time t7, control circuit 5 can control the bleeder circuit to operate by control signal IB. This can provide constant bleeder current Ib, and maintain output voltage VBUS identical or substantially consistent with the absolute value of AC input voltage AC_IN at the AC input terminals.

In addition, comparator CMP4 can compare output voltage VBUS of rectifier circuit 2 against preset value VBUS_LOW. At time t8, output voltage VBUS of rectifier circuit 2 may be less than preset value VBUS_LOW, which can indicate that output voltage VBUS of rectifier circuit 2 is close to zero, such that control circuit 5 can control bleeder circuit 4 to stop providing the bleeder current by control signal IB. In this example, after the silicon-controlled dimmer is turned off, the control circuit can control the bleeder circuit to start operating after waiting for the predetermined time, such that the silicon-controlled dimmer can be reliably turned off, thereby avoiding the bleeder circuit to operate without turning off the silicon-controlled dimmer, and avoiding affecting the output voltage of the rectifier circuit. In this way, the output voltage of the rectifier circuit can be identical or substantially consistent with the absolute value of AC input voltage AC_IN during the falling phase.

Figure 11:
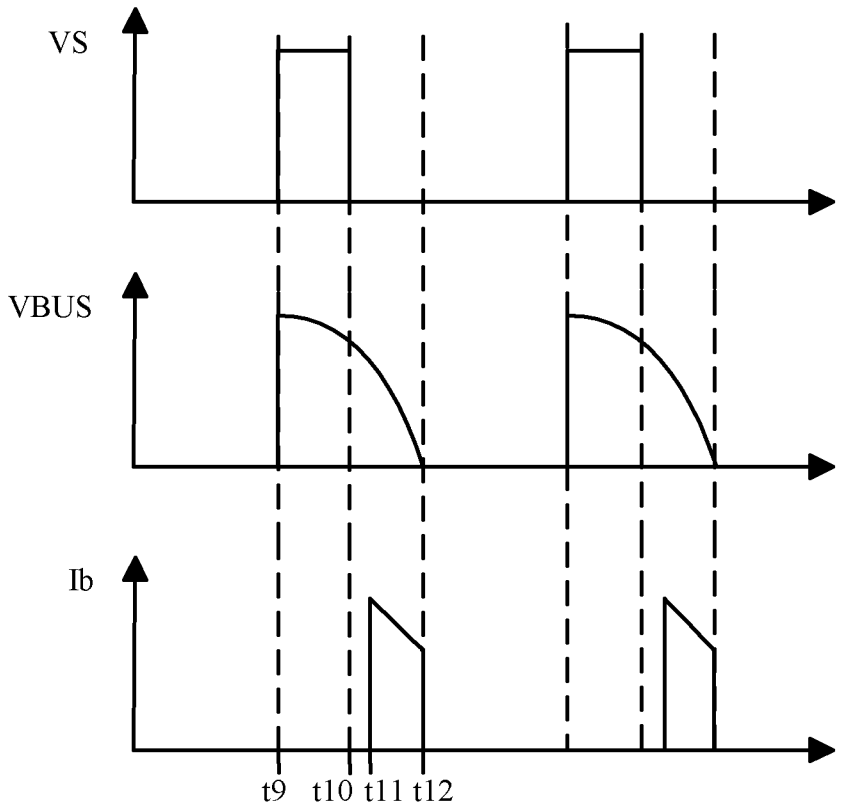
FIG. 11 is a waveform diagram of third example operation of the power converter, in accordance with embodiments of the present invention.

Referring now to FIG. 11, shown is waveform diagram of third example operation of the power converter, in accordance with embodiments of the present invention. In this particular example, at time t9, silicon-controlled dimmer 1 may be turned on, and the value of voltage VBUS is the same as the absolute value of AC input voltage AC_IN, such that the entire system can operate, and the output current of rectifier circuit 2 may change from 0 to a predetermined value and held until time t10. At time t10, silicon-controlled dimmer 1 can be turned off, which can cause output current IS of rectifier circuit 2 to drop to zero or to approach zero. Correspondingly, current sampling signal VS can also drop to zero or approach zero. By detecting current sampling signal VS, whether or not the bleed circuit is required to operate can be determined. In addition, due to the presence of parasitic capacitance, voltage VBUS may gradually decrease.

As shown in FIG. 11, at time t10, after control circuit 5 detects that current sampling signal VS is less than the predetermined threshold (e.g., the output current of the rectifier circuit is less than the current threshold), silicon-controlled dimmer 1 can be determined to be turned off, such that after predetermined time Δt2 (e.g., at time t11), bleeder circuit 4 can be controlled to provide bleeder current Ib. At time t12, when voltage VBUS falls below the preset value (e.g., substantially toward zero), control circuit 5 can control bleeder circuit 4 to stop providing bleeder current Ib. It should be understood that the timing of when the bleeder circuit stops operating may be set at other moments before time t4 at which silicon-controlled dimmer 1 is turned on in the next period.

In this example, after the silicon-controlled dimmer is turned off, the control circuit can control the bleeder circuit to start operating after waiting for the predetermined time, and control bleeder current Ib to gradually decrease, such that the silicon-controlled dimmer can be reliably turned off, thereby avoiding the bleeder circuit to operate without turning off the silicon-controlled dimmer, and avoiding affecting the output voltage of the rectifier circuit. In addition, since the discharge capacity of the capacitor is gradually decreased, the bleeder current is gradually decreased, such that the output voltage of the rectifier circuit can be better controlled to be consistent or substantially identical with the absolute value of the waveform of the AC input voltage during the falling phase.

It should be understood that the timing of when the bleeder circuit can be controlled to operate and stop operating may be determined according to particular applications. Further, the bleeder current may be generated when the input current of rectifier circuit 2 is less than the current threshold, or the bleeder current may be generated after waiting for the predetermined time when the input current of rectifier circuit 2 is less than the current threshold. The bleeder circuit may stop providing the bleeder current when the output voltage of rectifier circuit 2 is less than the preset value, or before the conduction time of the silicon-controlled dimmer in the next period. Further, the waveform of the bleeder current can be variability, which can be stable or decreasing, or other waveforms.

In particular embodiments, the bleeder current can be generated by the bleeder circuit of the power converter after the silicon-controlled dimmer is turned off, or after the silicon-controlled dimmer is turned off for the predetermined time, such that the negative influence caused by the capacitance of the silicon-controlled dimmer can be reduced, and the output voltage of the rectifier circuit can be kept identical or substantially consistent with the absolute value of AC input voltage AC_IN at the AC input terminals, thereby maintaining the silicon-controlled dimmer stably turned on during each period.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A power converter configured to drive a light-emitting diode (LED) load, the power converter comprising:

a) a rectifier circuit;

b) a silicon controlled dimmer coupled between an alternating current (AC) input terminal to receive an AC input voltage, and an input terminal of said rectifier circuit; and c) a bleeder circuit coupled to an output terminal of said rectifier circuit, and being configured to provide a bleeder current after an output voltage generated by said rectifier circuit becomes less than an LED driving voltage and said silicon controlled dimmer is turned off, and prior to said silicon controlled dimmer being turned on in a next period of said AC input voltage, wherein said LED driving voltage is a voltage drop between two terminals of said LED load, wherein said bleeder current is controlled to be constant after said output voltage generated by said rectifier circuit is less than a voltage threshold and before said output voltage generated by said rectifier circuit has decreased from said voltage threshold to zero.

2. The power converter of claim 1, wherein said bleeder circuit is configured to provide said bleeder current, such that said output voltage of said rectifier circuit is consistent with an absolute value of said AC input voltage at said AC input terminal during after said silicon controlled dimmer is turned off.

3. The power converter of claim 1, wherein said bleeder circuit is configured to provide said bleeder current when an output current of said rectifier circuit is less than a current threshold.

4. The power converter of claim 1, wherein said bleeder circuit is configured to provide said bleeder current after a predetermined delay time when an output current of said rectifier circuit is less than a current threshold.

5. The power converter of claim 1, wherein said bleeder circuit is configured to stop providing said bleeder current when said output voltage of said rectifier circuit is less than a preset value.

6. The power converter of claim 1, wherein said bleeder circuit is configured to stop providing said bleeder current before a rising edge of said output voltage of said rectifier circuit.

7. The power converter of claim 1, wherein said bleeder circuit is configured to provide said bleeder current to be constant or vary with time when said output voltage of said rectifier circuit is decreased to be less than a preset value.

8. The power converter of claim 1, wherein said bleeder circuit is configured to control said bleeder current to gradually decrease before a beginning moment of said next period of said AC input voltage.

9. The power converter of claim 1, further comprising a sampling resistor coupled to said rectifier circuit, and being configured to sample an output current of said rectifier circuit and generate a current sampling signal.

10. The power converter of claim 9, further comprising a control circuit configured to receive said current sampling signal and an output voltage of said rectifier circuit, in order to control said bleeder circuit to start operating for providing said bleeder current and stop operating.

11. The power converter of claim 10, wherein said control circuit comprises:

a) a first comparator configured to compare said current sampling signal against a current threshold; and b) a second comparator configured to compare said output voltage against a preset value, c) wherein said control circuit is configured to control said bleeder circuit based on output signals of said first and second comparators.

12. The power converter of claim 11, said control circuit further comprises:

a) a delay circuit coupled to an output terminal of said first comparator, and being configured to delay an output signal of said first comparator for a predetermined time; and b) an RS flip-flop having a set terminal coupled to an output terminal of said delay circuit, a reset terminal coupled to an output terminal of said second comparator, and an output terminal coupled to said bleeder circuit.

13. The power converter of claim 1, wherein said bleeder circuit is configured to provide said bleeder current after said output voltage generated by said rectifier circuit is less than said voltage threshold and before said silicon controlled dimmer is turned on in said next period.

14. The power converter of claim 1, wherein said bleeder current is controlled to be increased after said output voltage generated by said rectifier circuit has decreased to zero and before said silicon controlled dimmer has turned on in said next period.

15. A method of controlling a power converter that drives a light-emitting diode (LED) load, the method comprising:

a) providing a bleeder current flowing though output terminals of a rectifier circuit of said power converter after an output voltage generated by said rectifier circuit becomes less than an LED driving voltage and a silicon controlled dimmer is turned off, and prior to said silicon controlled dimmer being turned on in a next period of an alternating current (AC) voltage input to said power converter; and b) wherein said LED driving voltage is a voltage drop between two terminals of said LED load, wherein said bleeder current is controlled to be constant after said output voltage generated by said rectifier circuit is less than a voltage threshold and before said output voltage generated by said rectifier circuit has decreased from said voltage threshold to zero.

16. The method of claim 15, wherein an output voltage of said rectifier circuit is controlled to equal an absolute value of said AC input voltage by generating said bleeder current said after said silicon controlled dimmer is turned off.

17. The method of claim 15, wherein said bleeder current is generated when an output current of said rectifier circuit is less than a current threshold.

18. The method of claim 15, wherein said bleeder current is generated after a predetermined delay time when an output current of said rectifier circuit is less than a current threshold.

19. The method of claim 15, wherein said bleeder current is cut off when an output voltage of said rectifier circuit is less than a preset value.

20. The method of claim 15, wherein said bleeder current is cut off before a rising edge of said output voltage of said rectifier circuit.

21. The method of claim 15, wherein said bleeder current is constant.

22. The method of claim 15, wherein said bleeder current is controlled to be gradually decreased.

23. A power converter configured to drive a light-emitting diode (LED) load, the power converter comprising:

a) a rectifier circuit;

b) a silicon controlled dimmer coupled between an alternating current (AC) input terminal to receive an AC input voltage, and an input terminal of said rectifier circuit; and c) a bleeder circuit coupled to an output terminal of said rectifier circuit, and being configured to provide a bleeder current after an output voltage generated by said rectifier circuit becomes less than an LED driving voltage and said silicon controlled dimmer is turned off, and prior to said silicon controlled dimmer being turned on in a next period of said AC input voltage, wherein said LED driving voltage is a voltage drop between two terminals of said LED load, wherein said bleeder current is controlled to be variable after said output voltage generated by said rectifier circuit is less than a voltage threshold and before said output voltage generated by said rectifier circuit has decreased from said voltage threshold to zero.

* * * * *